US005290196A

United States Patent [19]

Steel

[11] Patent Number: 5,290,196

[45] Date of Patent: Mar. 1, 1994

[54] INFLATABLE FLOAT DEVICE

[76] Inventor: Brian V. Steel, 2604 Deidra Circle North, Tacoma, Wash. 98407

[21] Appl. No.: 981,804

[22] Filed: Nov. 25, 1992

[51] Int. Cl.[5] ..... B63C 9/08

[52] U.S. Cl. ..... 441/130

[58] Field of Search ..... 114/351, 354, 353; 441/128-132

[56] References Cited

U.S. PATENT DOCUMENTS

| | | | |
|---|---|---|---|
| 552,437 | 12/1895 | Heather | 114/354 |
| 1,562,276 | 11/1925 | Assenzio | 441/132 |
| 3,158,299 | 11/1964 | Weir et al. | 114/354 |

*Primary Examiner*—Jesus D. Sotelo

*Attorney, Agent, or Firm*—Jensen & Puntigam

[57] ABSTRACT

The device includes two inflatable pontoon members (10, 12) and a frame assembly (24) which extends between and is secured to the two pontoon members (10, 12). The frame assembly (24) includes a horizontal seat section (25) and a back section (33) which is movable between a horizontal position and a vertical position. Two back straps (70, 72) are provided on the frame assembly to facilitate carrying of the device when the back section (33) is in its horizontal position and to support the back section when the back section (33) is in its vertical position. Two stabilizing straps (92, 94) extend between the pontoon members (10, 12) beneath the frame assembly (24) to provide rigidity for the device.

14 Claims, 3 Drawing Sheets

FIG. 1
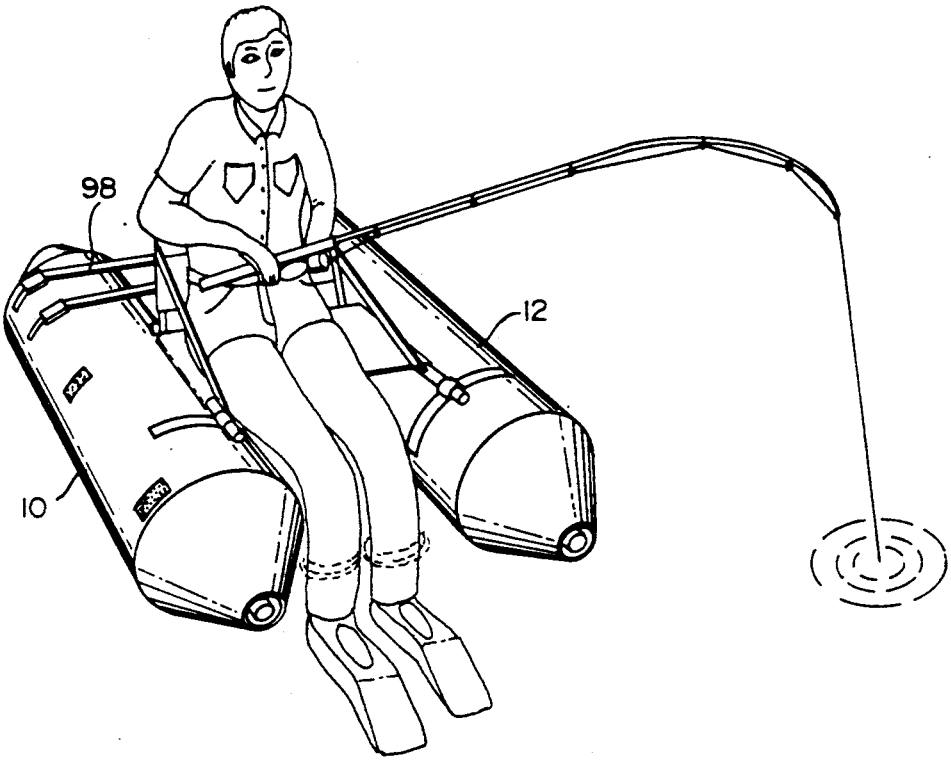
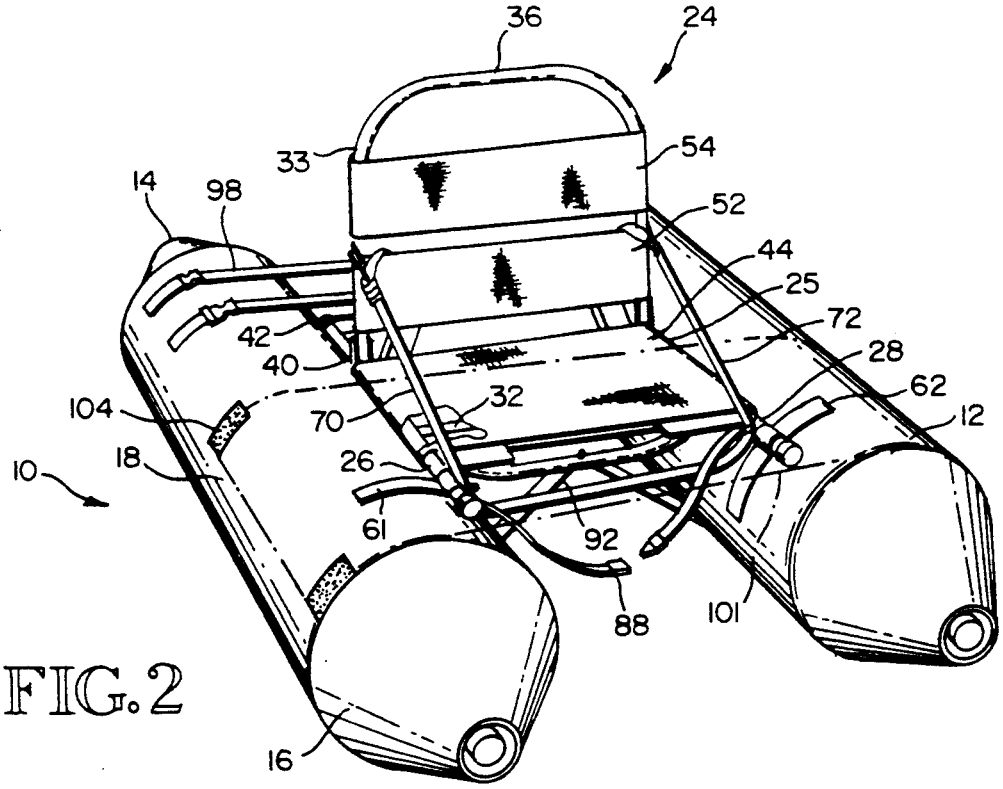
FIG. 2

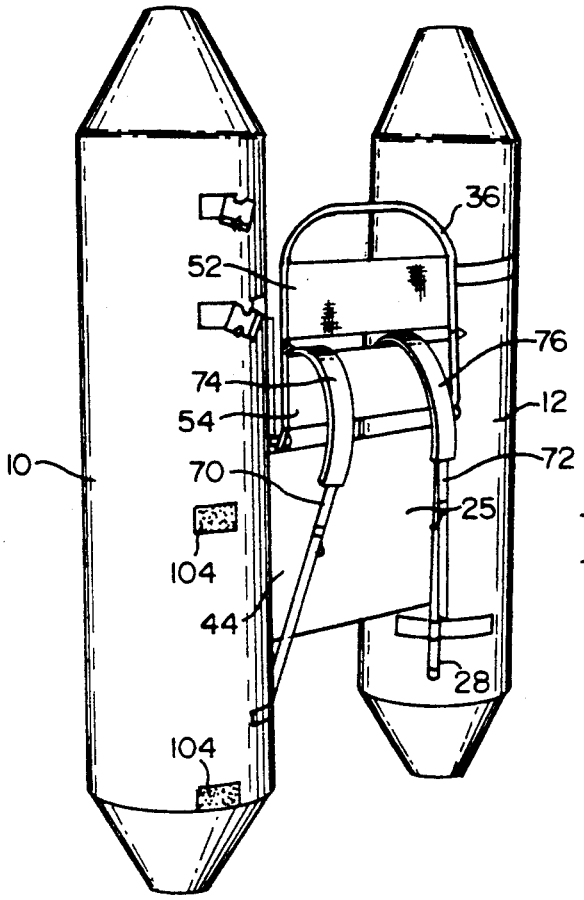
FIG. 5
FIG. 6
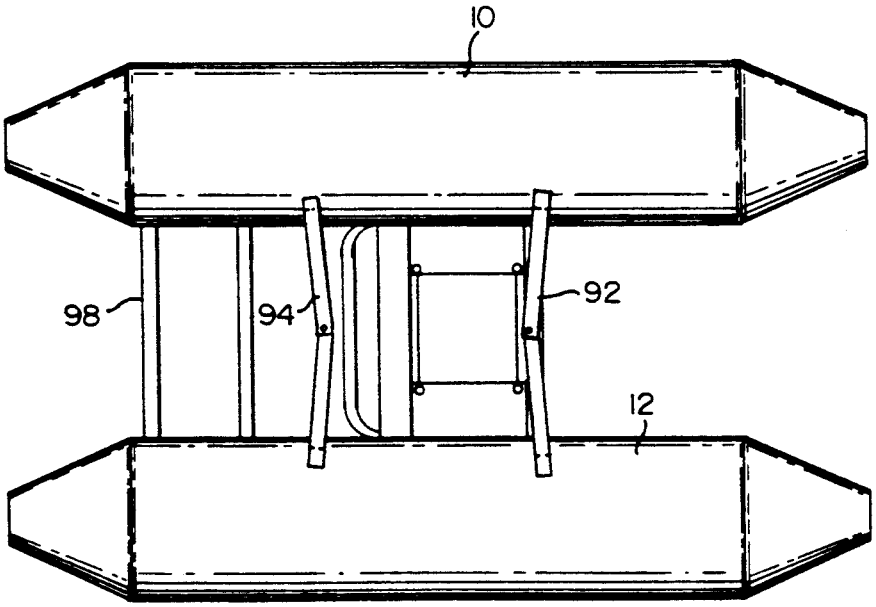

INFLATABLE FLOAT DEVICE

TECHNICAL FIELD

This invention relates to floatation devices used for recreational purposes, particularly fishing, which are often referred to generally as float tubes.

BACKGROUND OF THE INVENTION

Float tubes are generally well known in the recreational fishing industry as an accessory permitting convenient fishing in a body of water such as a lake at a distance from shore without a boat. Float tubes generally comprise a relatively large, donut-shaped inflatable member, similar to a large inner tube, having a suspended seat in the center area which is designed to support a user, such as a fisherman, in an upright position.

Float tubes have generally proved to be advantageous in lake and river fishing environments because they do not disturb the fish, like a boat does, and yet they provide comfort and support for a user and freedom to move about, while leaving the hands completely free for fishing. Typically, the user is equipped with fins to aid in propelling the float tube through the water.

However, conventional float tubes do have several disadvantages. They are cumbersome to carry, particularly by hand, such as under an arm. Hence, they are inconvenient to use when a substantial amount of walking is required to reach the desired destination. In addition, conventional float tubes are typically circular, which is sometimes disadvantageous in use, as well as being limited in space needed for fishing. Those float tubes which are not circular are often not very stable. Accordingly, there is a need for a float tube device which is conveniently portable yet provides good support for a seated user for fishing.

SUMMARY OF THE INVENTION

Accordingly, the present invention is an inflatable flotation device which comprises: inflatable means having an open center area; a frame assembly having two operating positions; means for securing the frame assembly to the inflatable means; means attachable to the apparatus which permits the device to be carried on the back of a user when the frame assembly is in a first, relatively flat, operating position; and elements carried on the frame assembly to support the user when the frame assembly is in a second, seat-like operating position.

BRIEF DESCRIPTION OF THE DRAWINGS

FIG. 1 is a perspective view of the float device of the present invention, showing the apparatus in actual use.

FIG. 2 is a perspective view of the float device of the present invention.

FIG. 5 is a perspective view of the complete float device of FIG. 2, shown in an upright position.

FIG. 6 is a bottom plan view of the complete float device of FIG. 2

BEST MODE FOR CARRYING OUT THE INVENTION

Figure 3:
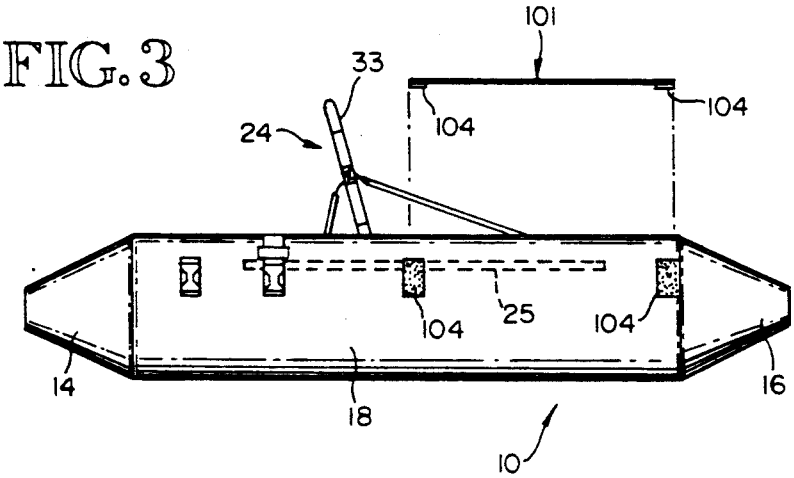
FIG. 3 is a side elevational view of the float device of FIG. 2.

Referring initially to FIGS. 2 and 3 of the drawings, the float device of the present invention includes two elongated, pontoon-like members 10 and 12. Each pontoon member is approximately five feet long, with end portions 14, 16 being approximately cone shaped. The intermediate portion 18 of each pontoon member between the two end portions 14, 16 is approximately cylindrical in configuration and in the embodiment shown is approximately 3½ feet long and 12 inches in diameter. Each pontoon member is made of reinforced vinyl or similar material and has a valve (not shown) for inflation and deflation.

While the embodiment shown includes two separate pontoon members, it should be understood that other configurations are possible, including a single pontoon member generally in the shape of a "U" or an extended semi-circle. In both such cases, the front portion of the single pontoon member is open, like the two pontoon embodiment.

Figure 4:
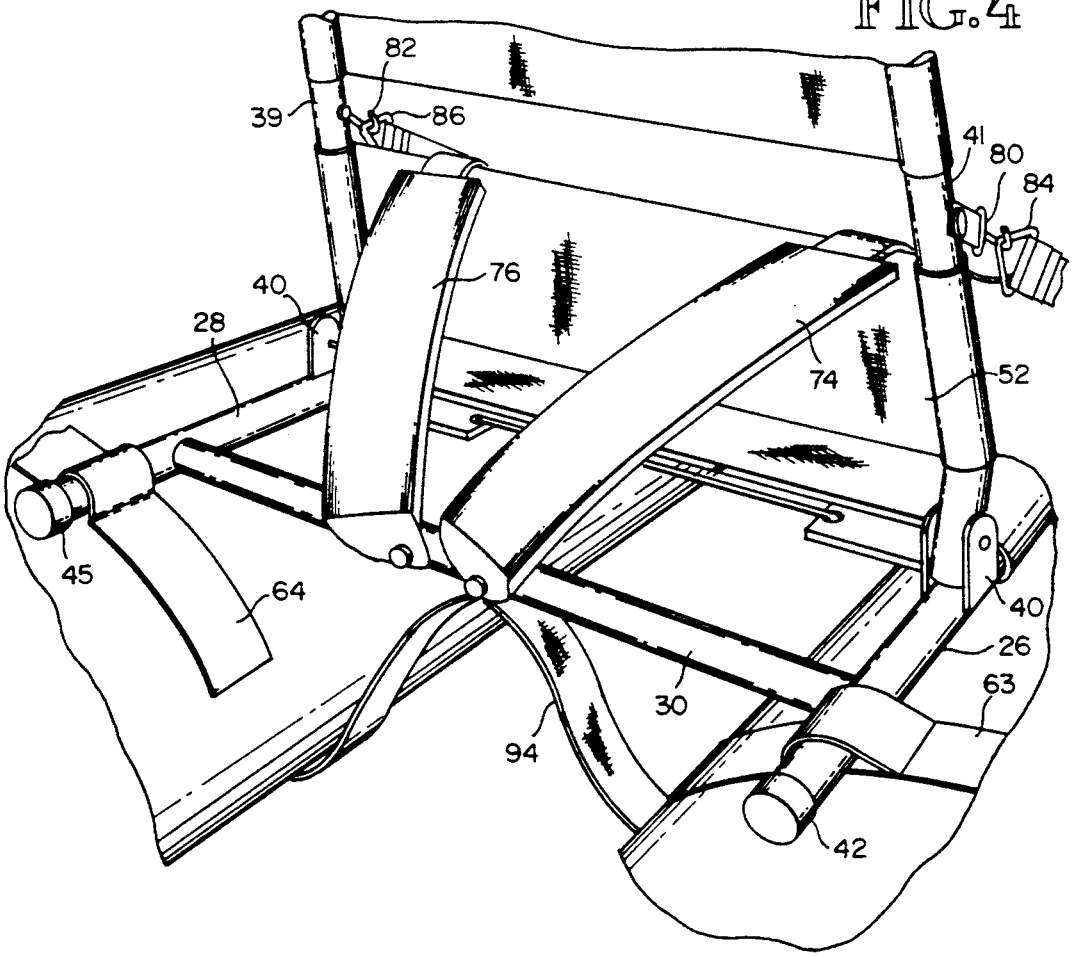
FIG. 4 is a rear view of a portion of the float device of FIG. 2.

A float frame 24 for the device, shown most clearly in FIGS. 2, 4 and 5, is somewhat similar to a conventional backpacking frame. It includes a base section 25 comprising two opposed parallel longitudinal tubes 26 and 28 and at least two cross bracing tubes 30 and 32. The frame 24 also includes a seat section 33 comprising a U-shaped tube 36. All the tubes are aluminum in the embodiment shown. The free ends of the U-shaped tube are pivotally connected to brackets 40—40 on the longitudinal tubes 26 and 28. The brackets 40—40 are located approximately 12 inches from the rear ends 42, 45 of the longitudinal tubes.

Extending between longitudinal tubes 26 and 28 forward of brackets 40—40 is a section 44 of seating material, which may be fabric or plastic of some kind. Fabric section 44 is approximately 19 inches wide, thereby providing an adequate size seating surface for a user. Extending across the U-shaped tube 36 are two or more back support fabric elements 52 and 54. In the embodiment shown, the back support elements are approximately 19 inches wide, and are also made from fabric or plastic.

The back section 33 is pivotable at brackets 40—40 between two basic operating positions. In a first position, back section 33 is horizontal and therefore generally in the same plane as seat section 25, such as shown in FIG. 5. In a second operating position, back section 33 is in a substantially vertical position, such as shown in FIGS. 2 and 3.

Frame 24 is secured to the two pontoon members 10 and 12 by means of straps 61 through 64, which secure each end of each longitudinal tube 26 and 28, to the opposing pontoons, generally close to the midheight point of each pontoon, on the inner side surfaces thereof, as shown most clearly in FIGS. 2 and 4. The position of the frame is somewhat adjustable by adjusting the underneath straps connecting the two pontoons, described below, which slightly rotate the two pontoons. Each strap is secured to a pontoon by means of glue or stitching, leaving a small diameter open area or raised section approximately mid length thereof between the strap and the surface of the pontoon, large enough to accommodate the diameter of the longitudinal tubes 26 and 28. The raised portions defined in each strap are usually configured to provide a relatively tight fit for the longitudinal tubes between the strap and the pontoons. This is shown most clearly in FIG. 4.

Connected to frame 24 are two backpack straps 70 and 72. The forward ends of the backpack straps are connected to longitudinal tubes 10 and 12, respectively, near the front ends thereof and then extend between the two fabric sections 52 and 54 in back section 33 to rear cross tube 30 of seat section 25, where they are secured near the mid-point thereof, as shown most clearly in FIG. 4. The two backpack straps 70 and 72 include cushioned portions 74 and 76 similar to conventional backpack straps. Straps 70 and 72 also include hook elements 80 and 82 which are connectable to matching rings 84 and 86 on the U-shaped tube 36. When hook elements 80 and 82 are connected to the ring elements 84 and 86, the back portion of the frame is maintained in a substantially vertical position while the user is leaning against it.

A waist strap 88 is removably secured to the seat section 25 near the front end thereof. The free ends of waist strap 88 are typically joined by a buckle 89. The strap itself is typically padded, for additional comfort. As will be described in more detail hereinafter, when back section 33 of frame 24 is in a horizontal position, the backpack straps 70 and 72 and frame 24 are similar to a conventional backpack, with the backpack straps extending over the shoulders of the user and waist strap 88 extending around the waist of the user. When back section 33 is in a vertical position, frame 24 operates as a seat mounted on the pontoon members.

Two stabilizing straps 92 and 94 extend between the two pontoon members 10 and 12 from the lower surfaces thereof. Each stabilizing strap, respectively, comprises two strap lengths, which extend from the opposite pontoons, to approximately a mid-point of the respective cross tubes 30 and 32 of the seat section 25 of frame 24. The two strap lengths comprising each strap are swivelly or pivotally connected to a cross tube. Stabilizing strap 92 is substantially co-planar (vertically) with cross tube 30 while strap 94 is co-planar with cross tube 32, as shown most clearly in FIG. 6. The stabilizing straps 92, 94 provide a rigidity to the device which makes possible the use of a relatively simple and light frame 24. For instance, it prevents the two pontoons from rotating outwardly. The straps 92 and 94 are, moreover, somewhat adjustable, such that the orientation of the pontoons can be slightly changed. In the embodiment shown, the stabilizing straps are flexible fabric material, although the strap could be substantially rigid and extend directly between the two pontoon members. Also, two single straps could be used, i.e. two 20-inch vinyl panels, extending between the two pontoons.

In addition to the above, one or two straps 98 may be provided between the two pontoon members 10 and 12, to the rear of frame 24. While not necessary to the operation of the device, straps 98 will tend to prevent the pontoons from dropping downwardly toward each other when the device is picked up by the frame. Also, the straps 98 can be used to facilitate carrying of additional items or equipment when the device is in the water.

Still further, a screen element or similar member 101 (FIG. 3) can be positioned across the front portion of the device between the two pontoons 10 and 12. The screen 101 can be attached at each corner thereof by Velcro or similar elements 104—104 to the pontoons. The screen 101 can be used as a table when the device is in the water.

The above-described apparatus is conveniently portable. This is accomplished by moving the back seat section 33 of the frame to a horizontal position. The two backpack straps 70, 72 are detached from the ring elements 84 and 86 of the back section, permitting the backpack straps to be pulled away from the frame, as shown most clearly in FIG. 5. The two backpack straps 70 and 72 and waist strap 88, with frame 24, can then be used in a manner similar to a conventional backpack, with the user carrying the float device on his back to a remote lake location, for instance.

In the embodiment shown, the float device is also relatively light, i.e. approximately 10 pounds, and therefore it is relatively easy to manage and carry with the disclosed frame arrangement, including the waist strap. In addition, the pontoons can be rotated inwardly (toward each other) to provide better clearance in tight situations, which may be encountered, for instance, along a trail or other cross-country route. When the desired location is reached, the user removes the device from his back, and the back section of the frame 24 is then raised to its vertical position with the straps 70, 72 being hooked to the rings on the back section to maintain the back section 33 in the vertical position. The float device is then ready to be used, as shown, for example in FIG. 1.

In actual use, a fisherman sits on the seat section of the frame 24 and moves the float device with the aid of flippers to a desired location in a lake or similar body of water. Fishing activities can then commence, with both hands being free for fishing. As indicated above, a table-like portion 101 can be mounted across the front of the device, while additional materials can be carried at the rear of the frame by the straps positioned there. When the fishing is over, the user simply maneuvers the float device back to shore.

The pontoon members 10 and 12 can be readily deflated and the entire device enclosed with a snap cover or the like for convenient shipment and/or other transportation.

Hence, a recreational flotation device has been described which is conveniently portable and which has relatively simple construction, yet provides convenient and reliable support for fishing and similar activities in a body of water such as a lake and the like.

Although a preferred embodiment of the invention has been disclosed herein for illustration, it should be understood that various changes, modifications and substitutions may be incorporated in such embodiment without departing from the spirit of the invention which is defined by the claims which follow:

What is claimed is:

1. An inflatable flotation apparatus, comprising:

inflatable flotation means having an open center area;

a frame assembly having a first, relatively flat, backpack configuration position and a second, seat configuration position, the frame assembly being movable between said first and second positions when the flotation means is inflated;

means attachable to the apparatus which permits the apparatus to be carried on the back of a user when the frame assembly is in its backpack configuration position and the flotation means is inflated; and elements carried on the frame assembly to support a user when the frame assembly is in its seat configuration position.

2. An apparatus of claim 1, wherein the inflatable means includes two spaced apart elongated pontoon members.

3. An apparatus of claim 2, including at least two bracing elements which extend between the two pontoon members, providing rigidity for the apparatus.

4. An apparatus of claim 3, wherein the bracing elements are attached at points on the lower surface of the pontoon members.

5. An apparatus of claim 3, wherein each bracing element comprises two flexible strap sections, each strap section attached at one end thereof to a pontoon member, respectively, and the other end to the frame assembly.

6. An apparatus of claim 2, including at least one strap extending between the two pontoon members to the rear of the frame assembly, the strap being removably connected to the pontoon members.

7. An apparatus of claim 2, including a screen member attachable to the pontoon members to define a table portion in front of the frame assembly.

8. An apparatus of claim 1, wherein the attachable means include two elongated straps which are connected to the frame assembly at two spaced-apart points, the straps including elements which permit selective attachment to the frame assembly at another point, to support the frame assembly in the second operating position.

9. An apparatus of claim 1, wherein the frame assembly comprises two sections, one section including two elongated longitudinal members and at least one cross member extending therebetween, and the other section including a generally "U"-shaped back member, the U-shaped member being pivotally connected to the first section so as to define the two positions of the frame assembly, wherein the elements carried on the frame assembly comprise fabric sections extending over a substantial portion of each section of the frame assembly.

10. An apparatus of claim 9, wherein the securing means includes strap elements which secure the respective ends of each longitudinal member of the one section to the inflatable means.

11. An apparatus of claim 9, wherein the attachable means includes two straps, respectively, which extend from the front end of the one section through the other section to the rear end of the one section, wherein the straps each include a hook element approximately mid-length thereof, which are connectable with ring elements on the other section to provide support for the other section in the second position of the frame assembly, the straps further including padded portions to facilitate convenient carrying of the device when the frame assembly is in the first position.

12. An inflatable flotation apparatus, comprising:

inflatable flotation means, comprising two spaced-apart elongated pontoon members;

a frame assembly having a first, relatively flat, backpack configuration position and a second, seat configuration position, wherein the frame assembly is movable between said first and second positions when the flotation means is inflated;

means for securing the frame assembly to the inflatable means;

elements carried on the frame assembly to support a user in a seated position when the frame assembly is in its seat configuration position; and a bracing element which extends between the two pontoon members, beneath the frame assembly, providing rigidity for the device.

13. An apparatus of claim 12, wherein the bracing element comprises two flexible sections, each section attached at one end thereof, respectively, to a pontoon member and at the other end to the frame assembly.

14. An apparatus of claim 12, wherein the frame assembly comprises two sections, one section including two elongated longitudinal members and at least one cross member extending therebetween, the other section including a generally "U"-shaped back member pivotally connected to the first section so as to define the two positions of the frame assembly wherein the elements carried on the frame assembly comprise fabric sections which extend over a substantial portion of each section of the frame assembly.

* * * * *